US006206981B1

(12) United States Patent
Jenkins

(10) Patent No.: US 6,206,981 B1
(45) Date of Patent: Mar. 27, 2001

(54) PROCESS FOR ENHANCING THE ADHESION OF ORGANIC COATINGS TO METAL SURFACES

(75) Inventor: Melvin R. Jenkins, Brighton, MI (US)

(73) Assignee: MacDermid, Incorporated, Waterbury, CT (US)

( * ) Notice: Subject to any disclaimer, the term of this patent is extended or adjusted under 35 U.S.C. 154(b) by 0 days.

(21) Appl. No.: 09/421,204

(22) Filed: Oct. 21, 1999

(51) Int. Cl.[7] ..... C23C 22/24

(52) U.S. Cl. ..... 148/264; 148/270; 148/271; 148/274; 148/275; 148/283; 106/1.11; 427/384; 427/409

(58) Field of Search ..... 427/384, 409; 148/264, 270, 271, 274, 275, 283; 106/1.11

(56) References Cited

U.S. PATENT DOCUMENTS

| | | | | |
|---|---|---|---|---|
| 3,239,467 | | 3/1966 | Lipinski | 252/144 |
| 4,148,670 | * | 4/1979 | Kelly | 148/6.15 R |

* cited by examiner

*Primary Examiner*—Erma Cameron
(74) *Attorney, Agent, or Firm*—Carmody & Torrance LLP

(57) ABSTRACT

A process is described for increasing the adhesion of organic coatings to metal surfaces, particularly aluminum and aluminum alloys. The process involves the utilization of an adhesion promoting composition in conjunction with a chromating composition in treating the metal surface prior to application of the organic coating. The adhesion promoting composition comprises (i) 1,2-bis(beta-chloroethoxy) ethane, (ii) a glycol ether, (iii) an oxidizing acid and (iv) a nitro sulfonic acid.

5 Claims, No Drawings

PROCESS FOR ENHANCING THE ADHESION OF ORGANIC COATINGS TO METAL SURFACES

BACKGROUND OF INVENTION

The present invention relates to a process for improving the adhesion of organic coatings such as paint to metal surfaces, particularly aluminum and aluminum alloys. The process cleans and prepares the metal surfaces such that subsequently applied organic coatings to the metal surfaces, such as paint, adhere to the metal surface in a superior fashion.

SUMMARY OF THE INVENTION

The proposed invention teaches the treatment of metal surfaces, particularly aluminum or aluminum alloy surfaces, with a process comprising:

1. Contacting the metal surface with an adhesion promoting solution comprising:
   a) a glycol ether;
   b) an oxidizing acid;
   c) a nitro sulfonic acid; and optionally, 1,2 bis(beta-chloroethoxy)ethane;
2. subsequently contacting the metal surface with a chromating composition in order to create a chromate conversion coating on the metal surface; and
3. subsequently applying an organic coating to the metal surface.

DETAILED DESCRIPTION OF THE INVENTION

The inventor herein that discovered that treatment of metal surfaces, particularly surfaces of aluminum and aluminum alloys, with a specific process greatly improves the adhesion of subsequently applied organic coatings to such metal surfaces. In order to accomplish this, the inventor proposes the following process:

1. contacting the metal surface with an adhesion promoting solution comprising:
   a) a glycol ether;
   b) an oxidizing acid; and
   c) a nitro sulfonic acid; and
   d) optionally, 1,2 bis(beta-chloroethoxy)ethane;
2. subsequently contacting the metal surface with a chromating composition in order to create a chromate conversion coating on the metal surface; and
3. subsequently applying an organic coating to the metal surface.

Many metals may be treated with the process of the invention but the inventor has found the process to be particularly useful in preparing aluminum and aluminum alloys for painting.

The adhesion promoting composition of the proposed process optionally contains 1,2-bis(beta-chloroethoxy) ethane at a concentration of from 0.1 to 10 percent by weight. Preferably the concentration of 1,2-bis(beta-chloroethoxy)ethane is from 0.5 to 2.0 percent by weight. 1,2-bis(beta-chloroethoxy)ethane is only sparingly soluble in water, however a glycol ether, or equivalent substance or solvent, may be utilized to increase the solubility of 1,2-bis (beta-chloroethoxy)ethane in the adhesion promoting composition.

The adhesion promoting composition may contain a glycol ether. Preferably the glycol ether will be a lower alkyl ether of ethylene glycol, propylene glycol, polyethylene glycol and polyproplene glycol. Some examples of appropriate glycol ethers include ethylene glycol mono butyl ether, ethylene glycol monomethyl ether, propylene glycol monomethyl ether, diethylene glycol monomethyl ether, diethylene glycol mono-n-butyl ether, diethylene glycol monohexyl ether, triethylene glycol monomethyl ether, other similar glycol ethers and mixtures of any of the foregoing. The concentration of the glycol ether may range from 2 to 40 percent by weight but is preferably from 10 to 20 percent by weight. Ethylene glycol mono-butyl ether, commonly marketed under the tradename Butyl Cellosolve, is a preferred glycol ether.

The adhesion promoting composition will contain an oxidizing acid. As indicated, the composition will also comprise a nitro sulfonic acid. The nitro sulfonic acid may also act as the necessary oxidizing acid.

The oxidizing acid is preferably nitric acid and/or a nitro sulfonic acid but most preferably both nitric acid and a nitro sulfonic acid are utilized in combination. The concentration of the oxidizing acid may range from 0.1 to 20 percent by weight, but is preferably from 0.1 to 10 percent by weight. If nitric acid is utilized in combination with a nitro sulfonic acid then the concentration of nitric acid (69%) is preferably from 0.1 to 2 percent by weight and the concentration of the nitrosulfonic acid is from 2 to 8 percent by weight.

The adhesion promoting composition contains a nitro sulfonic acid. Examples of useful nitro sulfonic acid include p-nitro benzene sulfonic acid, M-nitrobenzene sulfonic acid, 2-chloro-5 nitrobenzene sulfonic acid, 2,4 dinitrobenzene sulfonic acid, p-nitrotoluene sulfonic acid, 3,5 dinitro-p-toluene sulfonic acid and the like. The concentration of the nitrosulfonic acid may range from 2 to 10 percent by weight but is preferably from 3 to 8 percent by weight.

The adhesion promoting composition may also contain surfactants or water soluble polymers. The inventors have found that the addition of non-ionic surfactants and water soluble polymers are advantageous to the performance of the adhesion promoting composition. In particular homopolymers or copolymers of ethylene oxide and/or propylene oxide have been found to be useful. In addition non-ionic surfactants have also proven to be useful. The concentration of surfactant and water soluble polymers in the adhesion promoting composition may range from 0.5 to 3 percent by weight but is preferably from 1 to 2 percent by weight.

Finally, it may be advantageous to incorporate thickeners into the formulation, if the adhesion promoting composition is to be applied to vertical surfaces.

The chromating composition to be used in the process can be any composition capable of effectively creating a chromate conversion coating on the surface of the metal being treated. In this regard the teachings of U.S. Pat. No. 2,796,370 are herein incorporated by reference in their entirety. The inventors have found Iridite 14-2 a chromating solution available from MacDermid, Incorporated of 245 Freight Street, Waterbury, Conn. to be particularly useful in this regard.

The adhesion promoting composition and the chromating composition may be applied to the metal surface by either immersion, spray or equivalent method. The compositions should preferably remain in contact with the metal surface for a minimum of several minutes.

The inventors have found an unexpected synergism to occur when utilizing both the adhesion promoting composition and the chromating composition. The synergism is particularly unexpected since both the adhesion promoting composition and the chromating composition are reactive coatings (ie. react with the surface treated to create a modified surface). Conventional wisdom would dictate that it would not be advisable to employ two reactive coatings, one on top of the other since the first should either inhibit the formation of the second or the second will overcome and replace the first. In this case the unexpected synergism between the two coatings indicates that the coatings unexpectedly co-exist on the treated surface in some way.

The following example illustrates the foregoing invention but should not be taken as limiting in any way.

EXAMPLE I

An air-foil shaped piece of aluminum metal was processed through the following process:

| | Time |
|---|---|
| 1. alkaline soak cleaner to remove any oily residues | 7 minutes |
| 2. clean water rinse | 2 minutes |
| 3. adhesion promoting composition | 15 minutes |
| 4. clean water rinse | 2 minutes |
| 5. MacDermid Iridite 14-2 chromate | 5 minutes |
| 6. clean water rinse | 2 minutes |
| 7. dry | |

The adhesion promoting composition contained the following:

| Substance | Concentration (weight percent) |
|---|---|
| ethylene glycol monobutyl ether | 16 |
| p-nitro toluene sulfonic acid | 6 |
| 1,2 bis (beta-chloroethoxy) ethane | 1 |
| nitric acid (42 BE) | 0.4 |
| ethylene oxide homopolymer (MW = 7700) | 0.5 |
| ethoxylated non-ionic surfactant | 1 |
| water | 75.1 |

An epoxy primer and polyester top coat was applied to the processed aluminum specimen and allowed to cure. The adhesion of the paint was checked using the rain erosion method, a paint adhesion test method well known in the aerospace industry. In the rain erosion test water droplets impinge at high speed upon the line of demarcation between a painted and unpainted area on the specimen. The test is intended to simulate the water-blast stripping or eroding effect on the painted surface of an aircraft moving at high speed. A reasonable pass-fail criterion for this test requires that no greater than ¼ inch erosion occur behind the leading edge of the paint line. The specimen which was prepared in accordance with this example yielded a passing adhesion valve of not more than ⅛ inch erosion.

EXAMPLE II

Example I was repeated except that only steps 1,2 and 7 of the process were employed (ie. the aluminum was cleaned, rinsed and dried only). The same paint system cited in Example I was used along with the same testing scheme. The adhesion was found to be lacking in that the rain erosion test produced a maximum allowable erosion of ¼ inch or more.

I claim:

1. A process for improving the adhesion of an organic coating to a metal surface, said process comprising:

a. contacting the metal surface with an adhesion promoting composition comprising:
   1. a glycol ether;
   2. an oxidizing acid;
   3. a nitro sulfonic acid; and
   4. optionally, 1,2 bis(beta-chloroethoxy)ethane;

b. subsequently contacting the metal surface with a chromating composition; and c. subsequently applying an organic coating to the metal surface.

2. A process according to claim 1 wherein the metal surface comprises a metal selected from the group consisting of aluminum and aluminum alloys.

3. A process according to claim 2 wherein the adhesion promoting composition also comprises a material selected from the group consisting of non-ionic surfactants, homopolymers of ethylene oxide, copolymers of ethylene oxide, homopolymers of propylene oxide, copolymers of propylene oxide, and mixtures of any of the foregoing.

4. A process according to claim 2 wherein the adhesion promoting composition also comprises a thickener.

5. A process according to claim 3 wherein the adhesion promoting composition also comprises a thickener.

* * * * *